United States Patent [19]

Blakeburn, II et al.

[11] Patent Number: 4,959,139

[45] Date of Patent: Sep. 25, 1990

[54] BINDER PITCH AND METHOD OF PREPARATION

[75] Inventors: Dave L. Blakeburn, II; Ta-Wei Fu; Keith M. Roussel, all of Ponca City, Okla.

[73] Assignee: Conoco Inc., Ponca City, Okla.

[21] Appl. No.: 295,425

[22] Filed: Jan. 9, 1989

[51] Int. Cl.[5] ..... C10C 1/00; C10C 3/00

[52] U.S. Cl. ..... 208/39; 208/22; 208/44; 106/284; 106/273.1; 252/502; 252/510

[58] Field of Search ..... 208/22, 39, 44; 106/284, 273 R; 252/502, 510

[56] References Cited

U.S. PATENT DOCUMENTS

| | | | |
|---|---|---|---|
| 2,148,133 | 2/1939 | Reuscher | 106/284 |
| 2,527,595 | 10/1950 | Swallen et al. | 106/284 |
| 2,683,107 | 7/1954 | Juel | 208/23 |
| 2,772,219 | 11/1956 | Dunkel et al. | 252/510 |
| 2,848,424 | 8/1958 | Stanko | 106/284 |
| 3,035,932 | 5/1962 | McNamara et al. | 106/284 |
| 3,065,094 | 11/1962 | Sandberg | 106/284 |
| 3,102,041 | 8/1963 | Sandberg | 106/284 |
| 3,173,851 | 3/1965 | King et al. | 208/23 |
| 3,853,793 | 12/1974 | Brown et al. | 106/284 |
| 4,082,650 | 4/1978 | Li | 208/131 |
| 4,086,156 | 4/1978 | Dickakian | 208/44 |
| 4,096,097 | 6/1978 | Yan | 208/131 |
| 4,177,132 | 12/1979 | Uemura et al. | 208/22 |
| 4,231,857 | 11/1980 | Kato et al. | 208/22 |
| 4,744,797 | 5/1980 | Shimada et al. | 44/51 |
| 4,756,721 | 7/1988 | Correra et al. | 44/51 |

*Primary Examiner*—Helane Myers

*Attorney, Agent, or Firm*—Cleveland R. Williams

[57] ABSTRACT

Binder pitch is prepared by combining a petroleum aromatic mineral oil thermal tar and super finely subdivided calcined premium coke particles. The petroleum aromatic mineral oil thermal tar is obtained by hydrotreating, thermally cracking and vacuum distilling an aromatic mineral oil. Additionally, the aromatic mineral oil thermal tar may be subjected to heat soaking.

15 Claims, 2 Drawing Sheets

MINERAL OIL FEED
2
54
57
HYDROGENATION UNIT
4
5
HYDROGEN
6
FLASH TOWER
8
10
650°F- MATERIAL
12
54
FRACTIONATOR
18
C1-C3
20
GASOLINE
22
LT. GAS OIL
24
HEAVY GAS OIL
26
THERMAL CRACKER
28
30
16
14
32
THERMAL TAR
VACUUM TOWER
34
36
HEAVY GAS OIL
38
MIXING VESSEL
40
CALCINED COKE SUPER FINES
42
43
BINDER PITCH
44
FRACTIONATOR
46
C1-C3
48
GASOLINE
50
LT. GAS OIL
52
HEAVY GAS OIL
54
56
BINDER PITCH
54

MINERAL OIL FEED
102
166
HYDROGENATION UNIT 104
105
106
FLASH TOWER 108
110
650°F- MATERIAL
112
114
HYDROGEN
136
VACUUM TOWER 134
HEAVY GAS OIL
THERMAL TAR
132
116
FRACTIONATOR 118
112
C1-C3
120
GASOLINE
122
LT. GAS OIL
124
HEAVY GAS OIL
126
THERMAL CRACKER 128
130
164
FURNACE 140
138
142
HEAT SOAK VESSEL 144
146
MIXING VESSEL 148
150
CALCINED COKE SUPER FINES
152
BINDER PITCH
154
FRACTIONATOR 156
C1-C3
158
GASOLINE
160
LT. GAS OIL
162
HEAVY GAS OIL
164

BINDER PITCH AND METHOD OF PREPARATION

BACKGROUND AND SUMMARY OF THE INVENTION

Graphite electrodes used in electric arc furnaces for the production of steel are normally prepared from needle like or premium grade cokes. The quality of coke, especially premium coke, is often measured by its coefficient of thermal expansion which preferably should not exceed $9\times10^{-7}/°$ C. and most preferably $2\times10^{-7}/°$ C. on a fine grained flour artifact. The electrodes usually are prepared from coke which contains a particle size distribution with a maximum size of about ½ inch down to a fine flour. In a one embodiment, coke particle sizes are from 10 to 50 percent by weight +20 mesh with at least 20 weight percent of the particles less than 40 mesh. The particle size distribution and structure of the petroleum coke raw material in the electrode are substantially retained through the graphitizing process. The resulting graphitized specimens can be examined by microscopic methods so that the final graphite product can in part be characterized by the particle size distribution and structure of the raw material.

In carrying out the electrode manufacturing process subdivided premium coke which has been calcined is mixed with a binder, usually a coal tar pitch, and a small percentage of iron oxide. The iron oxide is used to control the "puffing" of high sulfur petroleum coke during the subsequent electrode graphitization process. Small amounts of non-viscous petroleum oil may be added to the mixture as a lubricant. The plasticized mixture of sized coke, pitch and iron oxide is extruded at temperatures near the softening point of the pitch to form green electrodes of approximately the required finished dimensions. Usually these electrodes are from about 18 to about 24 inches in diameter and may be of varying lengths.

The green electrode next is baked at a temperature from about 1400° to about 1800° F. during which the binder is carbonized to form a rigid body. Subsequent to the baking process, the electrode may be impregnated (one or more times) with an impregnating pitch and rebaked to eventually provide a higher density and strength and lower electrical resistivity.

The final process step is that of graphitization. The baked carbon electrodes are packed in furnaces surrounded by insulating materials and heated to temperatures near 5000° F. This temperature is necessary to convert the amorphous carbon in the electrode to the crystalline graphitic state.

The nature and quality of the binder used in the electrode manufacturing process is extremely important. Petroleum tars and pitches have not been heretofore proved useful for many reasons, such as the fact that electrodes so made are of uneven mechanical strength and are variable in electrical resistivity. Even highly aromatic tars resulting from cracking processes have failed to produce a satisfactory pitch by conventional means.

It is desirable to have sources of materials other than coal tar pitch for use as binders. It is particularly desirable to be able to use heavy oils, tars and other aromatic petroleum fractions for this purpose since these materials are readily available and often do not have other economically viable uses.

In accordance with this invention, binder pitch suitable for use in the preparation of graphite electrodes used in electric arc furnaces for the production of steel is obtained by hydrotreating an aromatic mineral oil, subjecting the hydrotreated material to thermal cracking, subjecting the thermal tar from the thermal cracking to vacuum distillation to recover a heavier thermal tar and combining the heavier thermal tar with super finely divided particles of calcined premium coke. In one aspect of the invention, the heavier thermal tar is subjected to a heat soak prior to combining it with the super fine particles of coke.

PRIOR ART

U.S. Pat. No. 3,102,041 discloses a binder pitch used in the manufacture of electrodes for use in the production of aluminum. A mixture of raw coke and calcined coke fines (66% through 200 mesh) are mixed with pitch to form the binder and larger coke particles are subsequently added.

U.S. Pat. No. 4,082,650 discloses a process for the production of petroleum coke by adding coke fines to a coke drum.

U.S. Pat. No. 2,683,107 discloses the preparation of binder pitch used in the manufacture of graphite electrodes in which calcined petroleum coke flour of 50±2 percent of 48/200 mesh and the remainder minus 200 mesh is combined with the binder.

U.S. Pat. No. 3,173,851 discloses the use of various sized fractions of calcined petroleum coke with aromatic tar to form a binder for use in the preparation of carbon electrodes. A coarse fraction of the coke is first added to the tar followed by the finer fractions. This patent also discloses the use of thermal tar obtained from steam cracking which is subjected to heat soaking or destructive distillation to obtain a suitable binder.

U.S. Pat. No. 3,853,793 discloses binder pitch prepared from a mixture of fully calcined coke fines and coke calcining kiln dust (which is only partially calcined) which has been ground to 60–80 percent by weight less than 200 mesh.

U.S. Pat. No. 4,086,156 discloses stripping steam cracker tar under reduced pressure, heat soaking the resulting pitch in the absence of oxygen and stripping the heat soaked pitch under vacuum to obtain a binder pitch.

U.S. Pat. No. 4,096,097 discloses combining ground calcined coke maximum particle size 50 mm, preferably 10–20 mm with a pitch binder.

U.S. Pat. No. 4,177,132 discloses mixing coal tar pitch or petroleum derived pitch with one hundred parts by weight of ground regular coke consisting of 18 parts particles greater than 10 mesh, 46 parts particles of 10 to 100 mesh and 36 parts particles finer than 100 mesh.

U.S. Pat. No. 4,231,857 discloses mixing petroleum derived pitch with 19 parts 10 mesh or larger, 26 parts 10–40 mesh, 26 parts 40–150 mesh and 29 parts 150 mesh or finer of calcined regular coke.

DETAILED DESCRIPTION OF THE INVENTION

The feedstocks used in the preparation of the binder pitch of this invention are petroleum aromatic mineral oil fractions. Specific feedstocks include such materials as decant oil, also known as slurry oil or clarified oil, which is obtained from fractionating effluent from the catalytic cracking of gas oil and/or residual oils. Another feedstock which may be employed is ethylene or pyrolysis tar. This is a heavy aromatic mineral oil which is derived from the high temperature thermal cracking of mineral oils to produce olefins such as ethylene. Another feedstock is vacuum resid which is a heavy residual oil obtained from flashing or distilling a residual oil under a vacuum. Still another feedstock is vacuum gas oil which is a lighter material obtained from flashing or distillation under vacuum. Thermal tar may also be used as a feedstock. This is a heavy oil which may be obtained from fractionation of material produced by thermal cracking of gas oil or similar materials. Heavy premium coker gas oil is still another feedstock and is the heavy oil obtained from liquid products produced in the coking of oils to premium coke. Gas oil from coking operations other than premium coking may also be employed as a feedstock. Virgin atmospheric gas oil may also be used as a feedstock. This is gas oil produced from the fractionation of crude oil under atmospheric pressure or above. The above mentioned feedstocks usually contain an amount of sulfur between about 0.8 and about 1.5 weight percent. Any of the preceding feedstocks may be used singly or in combination.

While any of the above feedstocks may be used, preferred are feedstocks which provide high yields of coke, such as thermal tars. decant oils, pyrolysis tars and various types of petroleum pitches.

Figure 1:
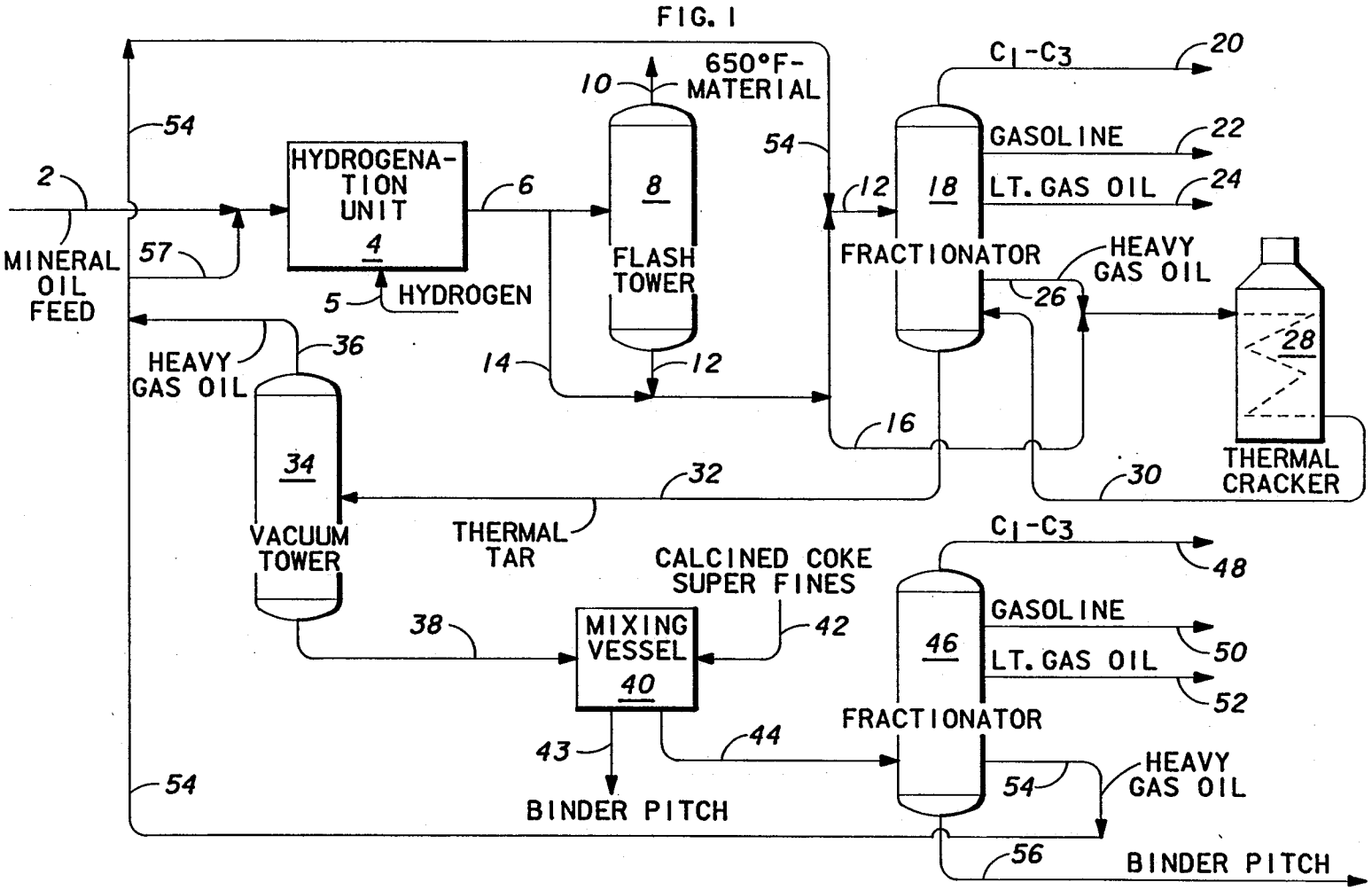
FIG. 1 is a schematic flow diagram including hydrotreating, thermal cracking and vacuum units adapted for carrying out the process and preparing the composition of the invention.

Referring now to FIG. 1, a petroleum aromatic mineral oil is introduced to catalytic hydrotreater 4 via line 2, with hydrogen being provided to the hydrotreater through line 5.

The catalyst used in hydrotreater 4 comprises a hydrogenation component deposited on a suitable inert carrier. Examples of the various hydrogenation components include the metals, salts, oxides, or sulfides of the metals of periodic groups VIII and VIIIB, for example, chromium, molybdenum, tungsten, iron, cobalt, nickel, ruthenium, rhodium, palladium, osmium, iridium, and platinum. The particular catalyst employed is not critical to the invention and any of the conventional catalysts used for hydrogenation can be used.

These catalysts are typically distended on a suitable inert support of carbon, for example, activated carbon or a dried and calcined gel of an amphoteric metal oxide, for example, alumina, titania, thoria, silica, or mixtures thereof. The most commonly employed carriers are the silica and alumina-containing carriers or mixtures thereof.

The hydrotreating process conditions employed may be summarized as follows:

HYDROTREATING CONDITIONS

| | Hydrotreating Conditions | |
|---|---|---|
| | Broad Range | Preferred Range |
| Temperature, °F. | about 500–800 | about 600–750 |
| Pressure, psig | about 500–1600 | about 600–1500 |
| $H_2$/Oil, SCFB | about 500–4000 | about 1000–3000 |
| LHSV | about 0.2–6 | about 0.5–2 |

The particular process conditions employed for hydrogenation will depend on the mineral oil feedstock which is used in the process. For purposes of the present invention, the hydrotreating requirements are simply that the overall conditions should be selected to effect sufficient desulfurization of the feed to provide a hydrotreated product containing not more than about 0.5 weight percent sulfur and preferably not more than about 0.35 weight percent sulfur.

Referring again to FIG. 1, the effluent from the catalytic hydrogenator is transferred via line 6 to flash tower 8 where this material is separated into a light fraction and a heavier fraction. The light fraction usually contains all of the light materials boiling below about 650° F., including hydrogen sulfide and nitrogen-containing gases.

The heavier fraction, which comprises from about 94 to about 99 weight percent of the hydrotreated material entering flash tower 8, is withdrawn from the flash tower through line 12 and introduced to fractionator 18 from which light gases, gasoline and light gas oil are taken off overhead as side products through lines 20, 22, and 24, respectively. A heavy gas oil material usually having a boiling range above about 500° F. is removed from fractionator 18 through line 26 and introduced to thermal cracker 28. If desired, a portion or all of the flash tower bottoms passing through line 12 may be combined through line 16 with the heavy gas oil feed to thermal cracker 28. In thermal cracker 28, temperatures of about 900° to 1100° F. and pressures of about 300 to 800 psig are maintained whereby this heavy material is converted to lighter compounds and to a thermal tar containing less hydrogen, higher aromatics and a higher carbon residue than the feed to the thermal cracker. Effluent from the thermal cracker is then recycled via line 30 to fractionator 18.

A thermal tar which comprises a major portion of coking components is withdrawn from the bottom of fractionator 18 through line 32 and introduced to vacuum tower 34. In vacuum tower 34, a separation is made to provide a heavy gas oil which is withdrawn from the top of the vacuum tower through line 36 and a heavier thermal tar which is removed from the vacuum tower through line 38. The latter material is introduced to mixing vessel 40 where it is joined by calcined coke super fines introduced through line 42. After mixing is completed, a binder pitch comprising the thermal tar and calcined coke super fines is withdrawn from mixing vessel 40 through line 43.

The calcined coke super fines used in the composition and method of this invention may be obtained from any available source of calcined premium coke by subjecting the coke to grinding to provide the desired particle size material. A convenient source of premium coke is the premium coke dust obtained as a by product of the coke calcining process. The gas discharged from a kiln incidental to the calcination of premium coke includes substantial quantities of dust constituted of fine coke particles. These particles are believed to be produced by wear and breakage of larger coke bodies in the kiln feed incidental to handling and tumbling of the feed inside the kiln. The rapid heating of the coke in the kiln may also contribute to particle formation. In any event, the amount of coke discharged from the kiln as fines or dust entrained in the kiln exhaust gases is as much as 5 to 10 percent by weight of the total amount of coke fed to the kiln. Commonly, the kiln flue gases containing the coke dust are passed through a dust collector or other separator which removes the kiln dust from the gas. Consequently, substantial quantities of this kiln dust accumulate incident to the large scale calcination of petroleum coke.

Since kiln dust represents a substantial fraction of the coke feed to a calciner, it is advantageous to utilize this material as a source of the super fines used in the composition and method of the invention. Although the coke dust is a very fine material, particularly when compared to the particles of coke which are ordinarily used in the preparation of graphite electrodes, it is still much too large in size to be used in the composition and method of the invention. A typical calcined coke dust has the following approximate composition.

| Particle Size (Tyler Mesh) | Wt % | Micron Equivalence |
|---|---|---|
| Through 100 Mesh | 60–80 | 150 |
| Through 200 Mesh | 20–40 | 75 |
| Through 325 Mesh | 5–25 | 45 |

As can be seen from the table, 60–80 percent of the dust is of a size of 75 microns or larger. The calcined coke super fine particles used in the process of the invention have an average micron size of between about 1 and about 40 microns, preferably between about 1 and about 8 microns, and more preferably not more than about 5 microns. Calcined coke particles having an average size of 5 microns will usually range in size from less than 1 to about 20 microns with the majority of the particles being in the range of between about 3 and about 12 microns. The above values are based on measurements made with a Malvern Particle Sizer 3600 E-type.

Returning again to the drawing, the calcined coke super fine particles which are introduced to mixing vessel 40 through line 42 are obtained by grinding calcined coke dust. Any suitable commercially available grinding equipment may be used for this purpose.

It may be desirable to subject the tar from vacuum tower 34 to an additional fractionation prior to using it in the binder pitch. In this event, binder pitch would not be withdrawn from mixing vessel 40 through line 43. Instead, the mixture of tar and calcined coke super fines would be transferred via line 44 to fractionator 46 wherein additional fractionation would take place. In this fractionator as in fractionator 18, lighter materials would be removed from the upper portion of the fractionator through lines 48, 50, and 52. The heaviest material in the fractionator would be removed from the bottom through line 56 and would constitute the binder pitch. If desired, a heavy gas oil fraction could be withdrawn from fractionator 46 through line 54 and combined with the feed to fractionator 18. Heavy gas oil from vacuum tower 34 may be combined with this recycle material and a portion of the combined recycle may be added to the fresh feed entering the hydrogenation unit via line 57.

Although the calcined coke super fines are preferably added to the tar leaving the vacuum tower, it is within the scope of the invention to introduce these fines to the system at other points. Thus, the fines may be added to the tar leaving the thermal cracker or to the bottoms leaving fractionator 46.

As mentioned previously, binder pitch is usually produced from a coal tar pitch, by fractional distillation of the coal tar. This produces a pitch with the following typical properties:

| | |
|---|---|
| Density (D-2320), g/cc | 1.33 1.33 |
| Modified Conradson Carbon (D-2416)*, Wt % | 58 |
| Micro Carbon Residue (D-4530)*, Wt % | 63 |
| Softening Point (D-3104)*, °C. | 110 |
| Toluene Insolubles (D-4072)*, Wt % | 30 |
| Quinoline Insolubles (D-2318)*, Wt % | 13 |
| Viscosity @ 150° C., cs | 3000 |
| Sulfur, Wt % | 0.6 |
| Flash Point (D-92)*, °C. | 260 |
| Ash (D-2415)*, Wt % | 0.4 |
| Distillation to 360° C., (D-2569) Wt % | 3 |

*ASTM methods.

The modified Conradson carbon and micro carbon residue are both indicators of coke value, that is, the amount of coke which will be produced from the binder pitch. If the coke value is too low the density and strength of the graphitized electrode produced from the Pitch will not meet the requirements of the steel industry. Thus maximum coke value is desired.

The coke value of the pitch and the softening point are the two most important properties of the pitch. If the softening point of the pitch is too high, it becomes difficult or impossible to extrude the electrodes at the pressures commercially available. With too low a softening point the electrode as extruded will be too soft and will deform. Even if the temperature of extrusion is lowered to solve this problem, the coke value of the resulting electrode will be too low for satisfactory electrode performance.

Still another important property of the pitch is the amount of quinoline insolubles. Quinoline insolubles in coal tar pitch are small spherical coke-like particles, generally less than 1 micron, which are formed by vapor phase pyrolysis during distillation of the coal tar.

The binder pitch composition of this invention has a Conradson carbon residue (D-2416) between about 50 and about 65 weight Percent, a softening point (D-3104) of between about 95° and about 130° C. and preferably between about 110° and about 120° C., and quinoline insolubles (D-2318) not exceeding 18 weight percent. The binder composition of the invention will contain between about 1 and about 18 weight percent of the super fine calcined coke particles and preferably between about 11 and about 15 weight percent of such particles.

Figure 2:
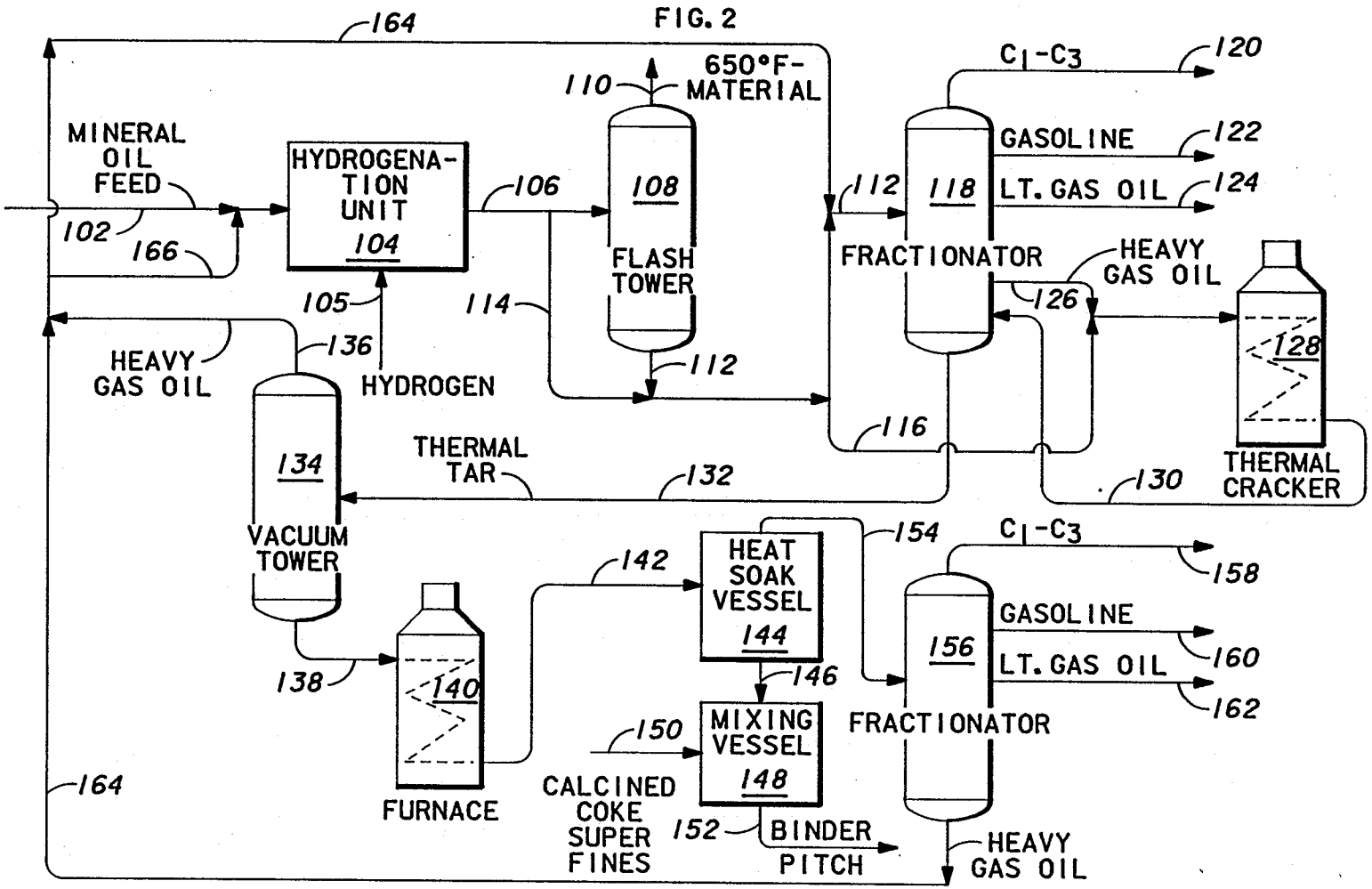
FIG. 2 is a similar schematic flow diagram which includes a heat soak unit.

If we refer now to FIG. 2, the mineral oil feed in this figure is processed in hydrogenation unit 104, flash tower 108, fractionator 118, thermal cracker 128, and vacuum tower 134, in the same manner as was described in the discussion of FIG. 1. The operating conditions employed are similar to or may be the same as those used in the process of FIG. 1.

The heavy tar leaving the bottom of fractionator 134 is passed through line 138 to furnace 140 wherein it is further heated and then transferred through conduit 142 to heat soak vessel 144. In this vessel, the tar is subjected to a temperature of from about 600° to about 975° F. for a period of between about 0.0030 and about 200 hours and preferably a temperature from about 750° to about 850° F. for a period of from about 1 to about 15 hours.

The heavy material in the heat soak vessel is then passed through line 146 to mixing vessel 148 where it is combined with calcined coke super fines introduced through line 150. After mixing in this vessel is complete, binder pitch is withdrawn from the vessel through line 152. Vapors from heat soak vessel 144 are passed through line 154 to fractionator 156 wherein this material is separated into several fractions, a gaseous material which is removed through line 158, a gasoline fraction removed through line 160 and a light gas oil which is removed via line 162. As in the operation in FIG. 1, heavy gas oil may be withdrawn from fractionator 156 and recycled to fractionator 118. Heavy gas oil from the vacuum tower may be combined with this material through line 136 and a portion of the heavy gas oil maybe combined with the feed to the hydrogenation unit through line 166.

As in the process described in FIG. 1, the calcined coke super fines maybe added at any point in the process after the thermal cracking. That is, either before or after the vacuum tower or before or after the heat soak vessel.

Mesophase often forms during heat soaking of petroleum feedstocks. This material may be detrimental to electrode properties when extruding and baking the electrode. Accordingly, the conditions employed during heat soaking are controlled to minimize the formation of mesophase.

The topped thermal tar obtained in the process of the invention may be used as impregnation pitch as well as a binder pitch. As pointed out previously, one use for impregnation pitch is in the baking step of preparing finished electrodes.

While the invention has been described by reference to the manufacture of binder pitches for use in the preparation of premium coke electrodes, the process of the invention may also be employed to prepare binder pitches for use in anodes used in the aluminum industry. Aluminum grade coke which is normally used in these binder pitches is of lesser quality than premium coke, e.g. it usually has a higher CTE than premium coke.

Petroleum based binder pitches as prepared by the method of the invention also find use as specialty binders which are characterized by higher melting points, up to 150° C. or higher. Such binders may be used in graphite brushes in electric motors, airplane parts, auto brake shoes, etc.

The following examples illustrate the results obtained in carrying out the invention.

EXAMPLE 1

A decant oil was hydrotreated using a cobalt-molybdenum on silica alumina catalyst at the following conditions:

| | |
|---|---|
| Average Bed Temperature, °F. | 655 |
| Liquid Hourly Space Velocity, 1/hr | 1.2 |
| Hydrogen Partial Pressure, psig | 720 |

The hydrotreated slurry oil was then thermally cracked at 950° F. to produce a thermal tar which was distilled in a single-stage vacuum distillation unit under the following conditions:

| | |
|---|---|
| Absolute Pressure, mm Hg | 2.0 |
| Vapor Temperature, °F. | 549 |
| Topping Temperature Corrected to 1 atm, °F. | 925 |

The topped thermal tar from the distillation had the following properties:

| | |
|---|---|
| Density, g/cc | 1.22 |
| Micro Carbon Residue (D-4530), Wt % | 56 |
| Softening Point (D-3461), °C. | 107 |
| Toluene Insolubles (Room Temp), Wt % | <1 |
| Sulfur, Wt % | 0.3 |

A premium grade of calcined coke was ground to produce the super fines with the following properties measured by a Malvern Particle Sizer 3600 E-type:

| | |
|---|---|
| Average Diameter by Volume, micron | 6.6 |
| Top Size | 0.5% @ 18 microns |

The topped thermal tar obtained above was blended with the calcined coke super fines to form a petroleum binder pitch with the following properties:

| | |
|---|---|
| Calcined Coke Super Fines, Wt % | 13 |
| Micro Carbon Residue (D-4530), Wt % | 61 |
| Softening Point (D-3461), °C. | 108 |

EXAMPLE 2

In the manufacture of graphitized electrodes, it is the properties of the coke formed from the pitch that are most important, not the pitch properties themselves. To determine the quality of coke produced by the pitch, the petroleum binder pitch of Example 1 and a coal tar binder pitch were coked at a temperature of 875° F. and a pressure of 60 psig for 8 hours.

The coke coefficients of thermal expansion (CTE) for the graphitized coke products, as estimated by a Conoco standard x-ray method, were found to be:

| | |
|---|---|
| Petroleum Binder Pitch, $10^{-7}$/°C. | 2.9 |
| Coal Tar Pitch, $10^{-7}$/°C. | 31 |

It is noted that the quality of coke produced from the petroleum binder pitch containing calcined coke super fines is much better than the coke produced from the coal tar binder pitch.

EXAMPLE 3

Electrodes with a diameter of 0.75 inches were made using the petroleum binder pitch of Example 1 and the coal tar binder pitch of Example 2 with the following formulation:

| | |
|---|---|
| Coke, Wt % | 70.4* |
| Pitch, Wt % | 25.4 |
| Lubricant, Wt % | 2.7 |
| Puffing Inhibitor, Wt % | 1.5 |

*35 Tyler Mesh - similar sizing to calcined coke dust.

The CTEs measured on these electrodes, baked to 850° C. and graphitized to 3000° C., were found to be:

| | |
|---|---|
| Petroleum Binder Pitch, $10^{-7}$/°C. | 2.2 |
| Coal Tar Pitch, $10^{-7}$/°C. | 3.3 |

The advantage of using petroleum binder pitch according to the process of the invention is clearly shown in this example.

EXAMPLE 4

A petroleum pitch was prepared by topping a thermal tar at the following conditions:

| | |
|---|---|
| Absolute Pressure, mm Hg | 2.0 |
| Vapor Temperature, −°F. | 528 |
| Topping Temperature Corrected to 1 atm., °F. | 900 |

The topped thermal tar (21 wt% yield) had the following properties:

| | |
|---|---|
| Micron Carbon Residue (D-4530), Wt % | 45 |
| Softening Point (D-3461), °C. | 80 |
| Toluene Insolubles (Room Temp.), Wt % | <1 |
| Sulfur, Wt % | 0.3 |

The topped thermal tar was heat soaked at the following conditions:

| | |
|---|---|
| Temperature, °F. | 670 |
| Pressure, psig | 15 |
| Time, hrs | 14 |

The heat soaked topped thermal tar had the following properties:

| | |
|---|---|
| Micro Carbon Residue (D-4530), Wt % | 59.9 |
| Softening Point (D-3104), °C. | 116.0 |
| Toluene Insolubles (Room Temp.), Wt % | 6.0 |

A premium grade of calcined coke was ground to produce super fines with the following properties measured by a Malvern Particle Sizer 3600 E-type.

| | |
|---|---|
| Average Diameter by Volume, micron | 7.1 |
| Top Size | 0.5% @ 20 microns |

The heat-soaked topped thermal tar obtained above was blended with the calcined coke super fines to form a petroleum binder pitch with the following properties:

| | |
|---|---|
| Micro Carbon Residue (D-4530), Wt % | 65 |
| Conradson Carbon Residue (D-189), Wt % | 57 |
| Softening Point (D-3104), °C. | 118 |
| Calcined Coke Fines, Wt % | 13 |

This binder pitch and two coal tar pitches were formulated and extruded to form 0.75-inch electrodes. The formulation and extrusion conditions are given in Tables 1 and 2, respectively.

TABLE 1

| Coke | Electrode Composition Wt % |
|---|---|
| 3/6 Tyler Mesh | 15.2 |
| 8/14 Tyler Mesh | 15.2 |
| 20/35 Tyler Mesh | 15.2 |
| −35 Tyler Mesh* | 30.4 |
| Pitch (Typical) | 20.6 |
| Lubricant | 1.8 |
| Iron Oxide | 1.6 |

*Similar sizing to calcined coke dust.

TABLE 2

| Electrode Sample | Pitch Amount Wt % | Extrusion Temp/°F. | Extrusion Pressure/psig |
|---|---|---|---|
| Coal Tar Pitch A | 28.5 | 280 | 1300 |
| | 27.5 | 280 | 1600 |
| | 26.5 | 280 | 2100 |
| | 25.5 | 280 | 3300 |
| Coal Tar Pitch B | 28.5 | 280 | 1850 |
| | 27.5 | 280 | 2050 |
| | 26.5 | 280 | 2600 |
| | 25.5 | 280 | 3600 |
| Petroleum Pitch | 25.5 | 280 | 1390 |
| | 24.5 | 280 | 1650 |
| | 23.5 | 280 | 2500 |
| | 22.5 | 280 | 2950 |

The electrodes described in Table 2 were baked to 900° C. and graphitized to 2900° C. and the properties of the graphitized electrodes were measured.

The properties of the electrodes are given in Table 3.

TABLE 3

| Electrode Sample | CTE $10^{-7}$/°C. | Resistivity $10^{-4}$ Ohm Inches | Baked Density g/cc | Graphitized Density g/cc |
|---|---|---|---|---|
| Coal Tar Pitch A | 3.8 | 3.5 | 1.55 | 1.50 |
| | 3.6 | 3.5 | 1.58 | 1.54 |
| | 3.4 | 3.5 | 1.60 | 1.56 |
| | 3.6 | 3.6 | 1.60 | 1.56 |
| Coal Tar Pitch B | 3.8 | 3.5 | 1.60 | 1.53 |
| | 3.7 | 3.4 | 1.60 | 1.56 |
| | 3.6 | 3.5 | 1.62 | 1.57 |
| | 3.6 | 3.6 | 1.64 | 1.59 |
| Petroleum Pitch | 3.1 | 3.6 | 1.63 | 1.58 |
| | 3.0 | 3.5 | 1.62 | 1.57 |
| | 3.1 | 3.7 | 1.62 | 1.58 |
| | 3.3 | 4.0 | 1.63 | 1.58 |

It is noted that the electrode prepared from the petroleum binder pitch containing 13 weight percent calcined coke super fines had a lower CTE, similar resistivity and higher density than the electrodes made from coal tar pitch. Also the petroleum binder pitch electrode had as high graphitized density as the electrode from coal tar pitch B and a higher graphitized density than the electrode from the other coat tar pitch.

EXAMPLE 5

70-mm electrodes were prepared from the petroleum binder pitch and the coal tar pitch B of Example 4. Another electrode was prepared from petroleum binder pitch which did not contain calcined coke super fines. Another electrode was prepared from petroleum binder pitch containing 13 wt% fines of −35 Tyler Mesh (similar sizing to calcined coke dust). The binder pitch had a softening point (D-3104) of 119° C. The formulation and extrusion conditions are given in Tables 4 and 5.

TABLE 4

| Coke | Electrode Composition Wt % |
|---|---|
| 3/6 Tyler Mesh | 15.3 |
| 9/14 Tyler Mesh | 15.3 |
| 20/38 Tyler Mesh | 15.3 |
| −35 Tyler Mesh* | 30.5 |
| Pitch (Typical) | 21.0 |
| Lubricant | 1.2 |
| Iron Oxide | 1.5 |

*Similar sizing to calcined coke dust.

TABLE 5

| Electrode Sample | Pitch Amount Wt % | Extrusion Temp/°F. | Extrusion Pressure/psig |
|---|---|---|---|
| Coal Tar | 27.5 | 267 | 2710 |
| Pitch B | 26.5 | 268 | 3720 |
| Petroleum | 21.5 | 270 | 2750 |
| Pitch | 20.5 | 270 | 3750 |
| Without Super Fines | | | |
| Petroleum | 25.5 | 270 | 1990 |
| Pitch | 24.5 | 270 | 2840 |
| With Super Fines | | | |
| Petroleum Pitch With −35 Tyler Mesh Fines | 24.5 | 270 | 2910 |

The electrodes were baked to 950° C. and graphitized to 2800° C. The properties of the electrodes are given in Table 6.

TABLE 6

| Electrode Sample | CTE $10^{-7}$/°C. | In Situ Coking Value of Baked Pitch | Graphitized Density g/cc | Modulus of Rupture Strength, psig |
|---|---|---|---|---|
| Coal Tar | 4.5 | 73.8 | 1.60 | 960 |
| Pitch B | 5.2 | 77.1 | 1.60 | 1030 |
| Petroleum | 3.6 | 71.1 | 1.57 | 830 |
| Pitch | 3.7 | 75.9 | 1.59 | 760 |
| Without Super Fines | | | | |
| Petroleum | 3.6 | 74.0 | 1.60 | 1030 |
| Pitch | 3.8 | 76.2 | 1.61 | 950 |
| With Super Fines | | | | |
| Petroleum Pitch with −35 Tyler Mesh Fines | 4.1 | 79.0 | 1.61 (est.) | 780 |

It is noted that the graphitized density of the electrode from petroleum pitch with super fines is higher than that of the electrode from petroleum pitch without super fines and is similar to that of the electrode from coal tar pitch B. Also, the CTE of all the electrodes from petroleum pitch is lower than the CTE of the electrode from coal tar pitch. Further, the in situ coking value of the baked petroleum pitch with super fines is higher than that of the baked petroleum pitch without super fines and is similar to that of the baked coal tar pitch B. Comparing the electrodes from petroleum pitch with and without superfines demonstrates the increase in MOR strength which is obtained by the addition of super fines. It is apparent that the strength of the electrodes from binder pitch containing super fines is much greater than that of the electrode which contains ordinary fines (−35 Tyler Mesh).

EXAMPLE 6

Three thermal tars were subjected to vacuum distillation to obtain a binder pitch material. The properties of the tars and the topped tars resulting from the distillation are set forth in Tables 7 and 8.

TABLE 7

| Description | Tar #1 | Tar #2 | Tar #3 |
|---|---|---|---|
| Specific Gravity | 1.033 | 1.084 | 1.071 |
| Distillation, °F. | 467–766 (80% Recovery) | 521–828 (70% Recovery) | 450–738 (60% Recovery) |
| Conradson Carbon (D-189), Wt % | 3.28 | 4.37 | 16.95 |
| Sulfur, Wt % | 0.31 | 0.98 | 0.75 |

TABLE 8

| Description | Tar #1 | Tar #2 | Tar #3 |
|---|---|---|---|
| Topping Temp, °F. | 800 | 800 | 780 |
| Softening Point (D-36), °F. | 127 | 113 | 230 |
| Conradson Carbon (D-189), Wt % | 26.6 | 20.1 | 41.4 |
| Sulfur, Wt % | 0.25 | 0.86 | 0.66 |
| THF Insolubles (Room Temp.), Wt % | 0 | 0 | 2.23 |

It is apparent that vacuum distillation alone will not produce a specification binder pitch. Tar #3 had an acceptable softening point, however, the Conradson carbon was too low.

EXAMPLE 7

The three topped tars from Example 4 were subjected to heat soaking at various temperatures and for varying time periods. The heat-soaking conditions and the properties of the heat-soaked product are shown in Table 9 and 10.

TABLE 9

| Sample | 800° F.+ Tar #1 | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Soak Temperature, °F. | 710 | 710 | 710 | 760 | 760 | 760 | 810 | 810 | 810 | 835 | 835 | 835 |
| Soak Time, hr | 0.75 | 1.5 | 2.5 | 0.75 | 1.5 | 2.5 | 0.75 | 1.5 | 2.5 | 0.75 | 1.5 | 2.5 |
| Properties | | | | | | | | | | | | |
| Softening Point (D-36), °F. | <41 | <41 | <41 | <41 | <41 | <41 | 64 | 75 | 70 | 93 | 119 | 110 |
| Conradson Carbon (D-189), Wt % | 11.0 | 8.1 | 8.8 | 10.2 | 12.3 | 9.0 | 16.7 | 17.6 | 27.5 | 22.8 | 27.4 | 30.9 |
| Sulfur, Wt % | 0.33 | 0.33 | 0.32 | 0.29 | 0.29 | 0.32 | 0.29 | 0.34 | 0.21 | 0.33 | 0.32 | 0.27 |

TABLE 9-continued

| Sample | 800° F.+ Tar #1 | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| THF Insolubles (Room Temp.), Wt % | — | — | — | — | — | — | — | — | — | — | — | — |

TABLE 10

| Sample | 800° F.+ Tar #2 | | | | | | 800° F.+ Tar #3 | | | | | |
|---|---|---|---|---|---|---|---|---|---|---|---|---|
| | 1 | 2 | 3 | 4 | 5 | 6 | 1 | 2 | 3 | 4 | 5 | 6 |
| Soak Temperature, °F. | 840 | 840 | 840 | 845 | 845 | 820 | 840 | 840 | 830 | 830 | 830 | 820 |
| Soak Time, hr | 0.75 | 1.5 | 2.5 | 0.75 | 1.5 | 5.0 | 0.75 | 1.5 | 0.75 | 1.5 | 2.5 | 3.0 |
| Properties | | | | | | | | | | | | |
| Softening Point (D-36), °F. | 151 | 184 | 240 | 137 | 218 | 236 | 325 | 352 | 322 | 362 | 370 | 345 |
| Conradson Carbon (D-189), Wt % | 35.1 | 41.7 | 53.5 | 31.6 | 49.9 | 55.1 | 62.3 | 68.0 | 60.4 | 70.0 | 68.6 | 68.6 |
| Sulfur, Wt % | 0.97 | 0.89 | 0.89 | 0.88 | 0.90 | 0.90 | 0.61 | 0.55 | 0.59 | 0.60 | 0.55 | 0.60 |
| THF Insolubles (Room Temp.), Wt % | 2.5 | 7.8 | 27.3 | 0.9 | 19.4 | 29.4 | 42.3 | 64.0 | 38.5 | 59.0 | 57.5 | 54.9 |

Tar #1 did not meet either softening point or Conradson carbon residue specifications for binder pitch. Tar #2 approached the desired softening point but the Conradson carbon residue was still too low. The THF insolubles increased dramatically in samples 3, 5 and 6, indicating the presence of mesophase in the pitch. As pointed out previously, mesophase is undesirable and is preferably excluded from the binder pitch. Tar #3 met the Conradson carbon residue specifications but the softening points were too high and the THF insolubles were extremely high. It does not appear that vacuum topping followed by heat soaking will produce a specification binder pitch.

While certain embodiments and details have been shown for the purpose of illustrating the present invention, it will be apparent to those skilled in the art that various changes and modifications may be made herein without departing from the spirit or scope of the invention.

We claim:

1. A process for the preparation of binder pitch which comprises:
   (a) subjecting a petroleum aromatic mineral oil to hydrotreating,
   (b) subjecting the hydrotreated product to thermal cracking,
   (c) subjecting thermal tar from the thermal cracking to distillation, and
   (d) combining topped thermal tar obtained from step (c) with finely subdivided calcined premium coke particles having an average diameter between about 1 and about 40 microns to form a binder pitch.

2. The process of claim 1 in which the finely subdivided coke particles have an average diameter of not more than about 5 microns.

3. The process of claim 2 in which the petroleum aromatic mineral oil is decant oil.

4. The process of claim 3 in which the finely subdivided calcined coke constitutes between about 1 and about 18 weight percent of the binder pitch.

5. The process of claim 4 in which the finely subdivided calcined coke is obtained by grinding coke flour formed during calcination of coke.

6. A process for the preparation of binder pitch which comprises:
   (a) subjecting a petroleum aromatic mineral oil to hydrotreating,
   (b) introducing effluent from the hydrotreating to a fractionation zone,
   (c) removing a heavy stream from the fractionation zone and subjecting it to thermal cracking,
   (d) returning effluent from the thermal cracking to the fractionation zone,
   (e) removing thermal tar from the fractionation zone and subjecting it to a second fractionation under vacuum, and
   (f) combining the thermal tar from the second fractionation zone with finely subdivided calcined premium coke particles having an average diameter between about 1 and about 40 microns to form a binder pitch.

7. The process of claim 6 in which the finely subdivided coke particles have an average diameter of not more than about 5 microns.

8. The process of claim 7 in which the petroleum aromatic mineral oil is decant oil.

9. The process of claim 8 in which the finely subdivided calcined coke constitutes between about 1 and about 18 weight percent of the binder pitch.

10. The process of claim 9 in which:
   (a) the thermal tar from the second fractionation zone is subjected to a heat soak wherein further cracking takes place, and
   (b) the heat soaked thermal tar is combined with finely subdivided calcined coke particles having an average diameter less than about 5 microns to form a binder pitch.

11. The process of claim 9 in which the finely subdivided calcined coke is combined with the thermal tar prior to the second fractionation.

12. The process of claim 10 in which the finely subdivided calcined coke is combined with the thermal tar prior to the heat soak.

13. The process of claim 10 in which the heat soaked thermal tar is subjected to a third fractionation prior to combination with the finely subdivided calcined coke.

14. The process of claim 1 in which the finely subdivided coke particles have an average diameter of between about 1 and about 8 microns.

15. The process of claim 6 in which the finely subdivided coke particles have an average diameter of between about 1 and about 8 microns.

* * * * *